US009451843B2

(12) United States Patent
Levelle

(10) Patent No.: US 9,451,843 B2
(45) Date of Patent: Sep. 27, 2016

(54) INSERTION AIDS

(71) Applicant: Peter Francis George Levelle, London (GB)

(72) Inventor: Peter Francis George Levelle, London (GB)

( * ) Notice: Subject to any disclaimer, the term of this patent is extended or adjusted under 35 U.S.C. 154(b) by 0 days.

(21) Appl. No.: 14/599,398

(22) Filed: Jan. 16, 2015

(65) Prior Publication Data

US 2015/0190007 A1 Jul. 9, 2015

Related U.S. Application Data

(63) Continuation-in-part of application No. PCT/EP2013/056534, filed on Mar. 27, 2013.

(30) Foreign Application Priority Data

Jul. 19, 2012 (GB) ..... 1213009.2

(51) Int. Cl.
*A47G 25/82* (2006.01)
*A47G 25/90* (2006.01)

(52) U.S. Cl.
CPC ..... *A47G 25/82* (2013.01); *A47G 25/90* (2013.01); *A47G 25/904* (2013.01)

(58) Field of Classification Search
CPC .... A47G 25/82; A47G 25/90; A47G 25/905; A47G 25/907; A47G 25/904
See application file for complete search history.

(56) References Cited

U.S. PATENT DOCUMENTS

| | | | | | |
|---|---|---|---|---|---|
| 1,710,138 | A * | 4/1929 | Bartholomae | A47G 25/82 | 223/118 |
| 1,913,709 | A * | 6/1933 | Gutmann | A47G 25/82 | 223/118 |
| 3,088,639 | A | 5/1963 | Sexton | | |
| 3,436,000 | A * | 4/1969 | Batista | A47G 25/82 | 223/118 |
| 4,290,539 | A | 9/1981 | Lowery | | |
| 4,858,795 | A * | 8/1989 | Selinko | A47G 25/905 | 223/111 |
| 5,601,220 | A * | 2/1997 | Vossen | A47G 25/907 | 223/111 |
| 5,799,844 | A * | 9/1998 | James | A47G 25/905 | 223/111 |
| 6,032,839 | A * | 3/2000 | Joosten | A47G 25/907 | 223/111 |
| 6,065,654 | A * | 5/2000 | Evensen | A47G 25/82 | 223/112 |
| 6,426,132 | B1 * | 7/2002 | Stewart | A47G 25/82 | 223/118 |
| 2007/0119882 | A1 | 5/2007 | Scott | | |

FOREIGN PATENT DOCUMENTS

| | | |
|---|---|---|
| DE | 102009034545 | 2/2011 |
| GB | 341089 | 1/1931 |
| GB | 2479161 | 10/2011 |
| GB | 2482199 | 1/2012 |
| KR | 20110008329 | 8/2011 |
| WO | 91/05498 | 5/1991 |

OTHER PUBLICATIONS

Search Report, Application No. GB1213009.2, Nov. 1, 2012.
International Search Report and Written Opinion, Application No. PCT/EP2013/056534, mailed Jul. 18, 2013.

* cited by examiner

*Primary Examiner* — Ismael Izaguirre
(74) *Attorney, Agent, or Firm* — McDonnell Boehnen Hulbert & Berghoff LLP

(57) ABSTRACT

A device for assisting the introduction of a body part into a tightly-fitting garment or footwear, comprising an elongate flexible laminar element of low friction material having load spreading means at one end of the element, operable, when a force is applied thereto, to spread the force across substantially the entire width of the laminar element, and handle means for manually gripping the load spreading means to assist in effecting withdrawal of the said laminar element from the interspace between a body part and a garment or footwear into which it has been introduced.

19 Claims, 8 Drawing Sheets

INSERTION AIDS

CROSS-REFERENCE TO RELATED APPLICATIONS

This application is a continuation-in-part application of co-pending PCT application PCT/EP2013/056534 filed 27 Mar. 2013, which claims the benefit of GB application number 1213009.2 filed 19 Jul. 2012. These applications are incorporated herein by reference in their entireties.

FIELD OF THE INVENTION

The present invention relates generally to a device for assisting the introduction of a body part into a tightly-fitting garment or footwear. Such a device will be referred to herein as an insertion aid. A device formed in accordance with the principles of the present inventions finds particular utility in assisting in the fitting of a foot into a boot, a limb into a sleeve or leg, or a digit into a finger (of a glove) although this list is not exhaustive.

BACKGROUND

In many areas of life it is necessary, or sometimes just convenient to have tightly-fitting clothing or footwear. Unfortunately, with such tightly-fitting items it can be difficult for a user to put them on to the relevant part of his or her body. For example, a wetsuit has to be closely fitting to a user's skin. It can be difficult for a user to introduce a limb into the sleeve or leg of such an item of clothing because, in order to make them tightly-fitting, they are usually, in the relaxed state, slightly smaller than the diameter of the limb to which they are associated. Introducing an arm into a sleeve, for example, then stretches the sleeve to fit snugly around the arm. This applies not only to wetsuits for water sports but to any other close-fitting garments, such as those made of lycra, rubber or leather and especially those used for sporting purposes such as cycling, running or the like. Furthermore, it is sometimes difficult for less-able bodied people to introduce a limb into a garment or shoe for example.

As far as footwear is concerned, it is known that ski boots for example must fit firmly in order to protect a user's ankle and ensure the necessary close contact between the skier and the skis which enables the skier to position the skis in the correct orientation in order successfully to negotiate the slope and/or any obstacles which may be encountered during a downhill run. Ski boots are made with pivoted or hinging components, which enable the opening through which the user's foot is to be introduced to be enlarged to make it less difficult to introduce, but even with this contrivance, considerable difficulty can be encountered, especially in seeking to introduce the heel past the rear ankle support of the boot. Likewise, snowboarders require closely-fitting footwear and the present invention is relevant in this area too.

Similarly, in another field, Wellington boots used widely throughout agricultural and horticultural environments, can be difficult to put on if they are to have a reasonably tight fit. The alternative, of wearing loose boots is not normally acceptable, especially if the boot is to be worn for a long period of time. Thus, in order to fit the garment or boot onto the body part, considerable force may be required to overcome the friction or resistance between the body part, which may be already partly clothed, and the garment or footwear into which it is being introduced. In the case of a ski boot, as discussed above, considerable downward force may be required on the user's foot and ankle to overcome the frictional resistance between the boot liner and the user's sock so that there is a risk of injury from excessive force, and, even if injury is avoided, the whole experience may be unpleasant, painful, time consuming and disagreeable. Individuals with weak, damaged and/or artificial knee joints may have particular problems when fitting ski boots or Wellington boots.

Although the pivoted, modern, rear entry ski boots have eased the problem and made for easier fitting, these nevertheless still require quite a considerable force on the user's foot especially in the region of the heel when the foot is being introduced into the interior of the boot, and this occurs at a time when the foot is pronated and the ankle is therefore under more than usual stress. Although some particular examples of footwear and clothing have been given above it will be appreciated that this is without prejudice to the generality of the present invention and its field of application. Tightly-fitting footwear is found in many other areas, such as ladies' fashion lines, equestrian wear and others too numerous to mention.

The present inventions seeks, therefore, to provide means by which the above-discussed problems can be eased, in which the introduction of a finger or hand into a glove, an arm into a sleeve, a leg into a leg, or a foot into a boot and so on can be rendered more comfortable and much less stressful. The overall problem is recognised to be the amount of friction involved in the exercise, and it is known that frictional forces are related to the area of contact between the relatively moving parts and to the contact forces exchanged between them. Since neither of these factors can be materially changed in the garments or footwear the only difference which is available is a change in the co-efficient of friction. However, it is not possible simply to utilise a material having a low coefficient of friction in the manufacture of the garment or the footwear since in some instances as described above, once fitted, a close-coupling between the garment and the user may be desired so that relatively high friction materials are often the preferred choice.

The conflicting requirements of low friction upon introduction of the body part into the garment, and high friction after the introduction has been effected, can be met, according to the invention, by providing a low-friction insert element which can be positioned over the body part or in the garment or footwear, allowing simple low-friction introduction of the body part into the garment or footwear, the inert element subsequently being removed from the interface between the body part and the garment or footwear with ease and stored for subsequent use.

One of the problems with such an arrangement, however, is that the interspace between the body part and the garment or footwear is typically extremely small, even non-existent in the case of elasticated or resilient garments which "grip" the user's limb or foot in use, so any such introduction aid must necessarily be extremely thin in order for it to successfully be used and removed with damaging either the garment or footwear or the aid itself.

Thin material having sufficient tensile strength to resist the forces exchanged between the material and the immediately adjacent body part and/or garment or footwear part is available, but a major difficulty is encountered in producing such an element in which there are adequate means for the user to grip the element in order to draw it out of the position in which it has been located for the introduction to take place. Prior art such elements have utilised holes formed in an elongate thin strip such as that as described in GB Patent application 2 408 442, whereas a rather thicker material with an integral gripping portion in the form of a flexible shoe horn is described in U.S. Pat. No. 3,396,883. A different form of footwear insertion apparatus is described in U.S. Pat. No. 6,065,654, but the means for a user to grip the element to withdraw it simply comprise two holes formed in the element itself, and the reduction in cross-sectional area at the point at which the forces are applied inevitably result in the risk of tearing or rupture of the material during use.

The present invention seeks to provide means by which the above difficulties and deficiencies in the prior art can be overcome, by providing a device for assisting the introduction of a body part into a tightly-fitting garment which will be capable of resisting the forces exerted on it by a user during the action of withdrawal of the insertion aid after the body part has been successfully introduced.

SUMMARY

According to the present invention, therefore, a device for assisting the introduction of a body part into a tightly-fitting garment or footwear, comprises an elongate flexible laminar element of low friction material having load-spreading means at one end of the element operable, when a force is applied thereto, to spread the force across substantially the entire width of the laminar element, and handle means for manually gripping the load-spreading means to assist in effecting withdrawal of the said laminar element from the interspace between a body part and a garment or footwear into which it has been introduced.

In this way the problems associated with rupture or tearing of the laminar element in a prior art device when it is withdrawn from the working position, can be overcome.

In one embodiment the laminar element is a single layer of material although a multiple layer element may also be produced, either by folding a single layer into two (in which case the load-spreading means may be secured to the fold) or by forming the elongate flexible laminar element as a tube which can then be flattened. Elements having more than two layers are, furthermore, also envisaged, either by the provision of a reinforcing intermediate layer between two layers of low-friction material, the reinforcing layer having greater structural strength and acting to absorb the forces exerted on the device in use, or by coating the structural element with one or more layers of low-friction material such as silicone for example.

In embodiments of the invention having multiple layers, it is preferred that the longitudinal edges of the material be secured together either by welding or adhesive, or, as in the case of a flattened tube, because they are integral with one another.

In some embodiments, the laminar element can be a single layer of fabric, such as a rip-stop fabric. For example, a rip-stop nylon or polyester fabric may be used. The fabric may be silicone-coated, or otherwise provided with a coating or layer of low friction material. Other materials for the fabric or coating may be used as will be appreciated.

The load-spreading means may be secured to the elongate flexible laminar element in any one of a number of ways. In a preferred embodiment it is secured to the end of the elongate flexible laminar element by welding, although securing it by adhesive could also be sufficient, and whether welded or secured by adhesive, there may be additional fixing elements such as rivets reinforcing the connection.

In an example, a layer of fabric for the laminar element may be wrapped over the load spreading means. This may then be fixed together underneath the load spreading means, such as by sewing the wrapped over portion to the laminar element for example, or by welding or gluing the portions together.

Likewise, the handle means may be attached to the load-spreading means in any of a number of different ways. Ideally, the handle means may be formed integrally with the load-spreading means although this is not essential and in different embodiments which will be described in more detail below various forms of handle means which are attachable to separately-formed load-spreading means are discussed.

In a preferred embodiment of the invention the load-spreading means may be formed in two parts and the elongate flexible laminar element secured between them. Alternatively, of course, especially in the case of a multiple layer elongate flexible laminar element opposite layers may be secured on opposite faces of the load-spreading means. For example, a portion of the load spreading means can be arranged so that it is secured within a laminar element. Furthermore, in the case that the laminar element includes an intermediate layer between two or more layers of low-friction material, a load spreading means can be secured such that the intermediate layer is secured between two parts of the means, with opposite layers of the low-friction material secured to opposite outer faces of the means for example.

In a preferred embodiment of the invention the elongate flexible laminar element is made of polyethylene. The thickness a single layer of the polyethylene laminar element may lie between 90 and 130 microns, preferably between 100 and 120 microns. In embodiments using multiple layers each layer may be between 60 and 85 microns, and preferably between 70 and 75 microns. The load-spreading means may, likewise, be formed from high-density polyethylene (HDPE) and this is also a suitable material for the handle, whether formed integrally with or separately from the load-spreading means.

The polyethylene may have an additive to reduce its coefficient of friction, although this detrimentally affects its tensile strength and the use of a load spreader helps by permitting a greater degree of "slipperiness" to be introduced.

Like the load-spreading means, the handle itself may be formed in two parts, the two parts being secured together upon assembly. Alternatively, in the case of a single layer of fabric for example, which is wrapped over the load spreading means and secured to itself, the load spreading means and the handle may be a unitary element. That is, the load spreading means and the handle may be one part, or may be formed from multiple parts that are connected together to form the load spreading means and the handle for the device.

In an embodiment, the elongate flexible laminar element is substantially rectangular. Alternatively, however, and especially for particular functions, the elongate flexible laminar element may be tapered, narrowing away from the handle (for example for use in assisting the introduction of arms into sleeves or digits into the figures of a glove, see FIG. 7), and for other purposes the elongate flexible laminar element may be tapered, narrowing towards the handle, see FIG. 6. Such an element effectively widens away from the handle, and this may be of particular use in fitting feet into boots since the wider distal end of the element (a proximal end being that attached to the handle) can wrap further around the heel providing a greater low-friction contact area. It will be appreciated however, that the elongate flexible member may be of any particular shape to suit the function for which it is designed, and this can include irregular shapes, including shapes that are composed of different portions, such as that designed to assist the introduction of multiple fingers into a glove for example, in which case the distal end of the element can be composed of multiple suitably (such as finger) shaped elements that will permit the introduction of more than one body part at a time. In the case of a glove aid for example, the flexible laminar elements can be shaped so as to effectively mirror the shape of a hand or glove. Similarly, in the case of other garments, such as trousers or a wet suit for example, the flexible laminar element, or a distal portion thereof can be suitably shaped and include portions for respective legs.

Therefore, an elongate flexible member 12 can include multiple portions 12*a* and 12*b* for insertion into a garment or footwear. See, for example, FIG. 8. The multiple portions can be shaped and/or arranged to substantially mirror a shape of a garment. For example, the multiple portions can have respective profiles that match that of the internal dimension of portions of a garment into which they are to be inserted. In the case of a trousers or a trouser like garment for example, two elongate portions can be provided that can be either rectangular or profiled to substantially mirror the internal shape and dimensions of the legs of the trousers. See FIG. 8.

In some examples, multiple handles can be provided on a load spreading means. In the example noted above, two handles can be provided for example, each of which can be arranged to lie over the central region of the multiple portions. In this case, each handle can be gripped and the device removed after legs have been inserted into a garment. The provision of multiple handles can mitigate the situation where a single handle may cause the device to bias in a particular direction when being removed, and can help to ensure that the load is evenly spread across the load spreading means and that the device is easier to remove when, for instance, a larger device is used thereby potentially resulting in a larger effort required to remove it.

BRIEF DESCRIPTION OF THE DRAWINGS

Various embodiments of the present invention will now be more particularly described, by way of example only, with reference to the accompanying drawings, in which.

DETAILED DESCRIPTION

Figure 1:
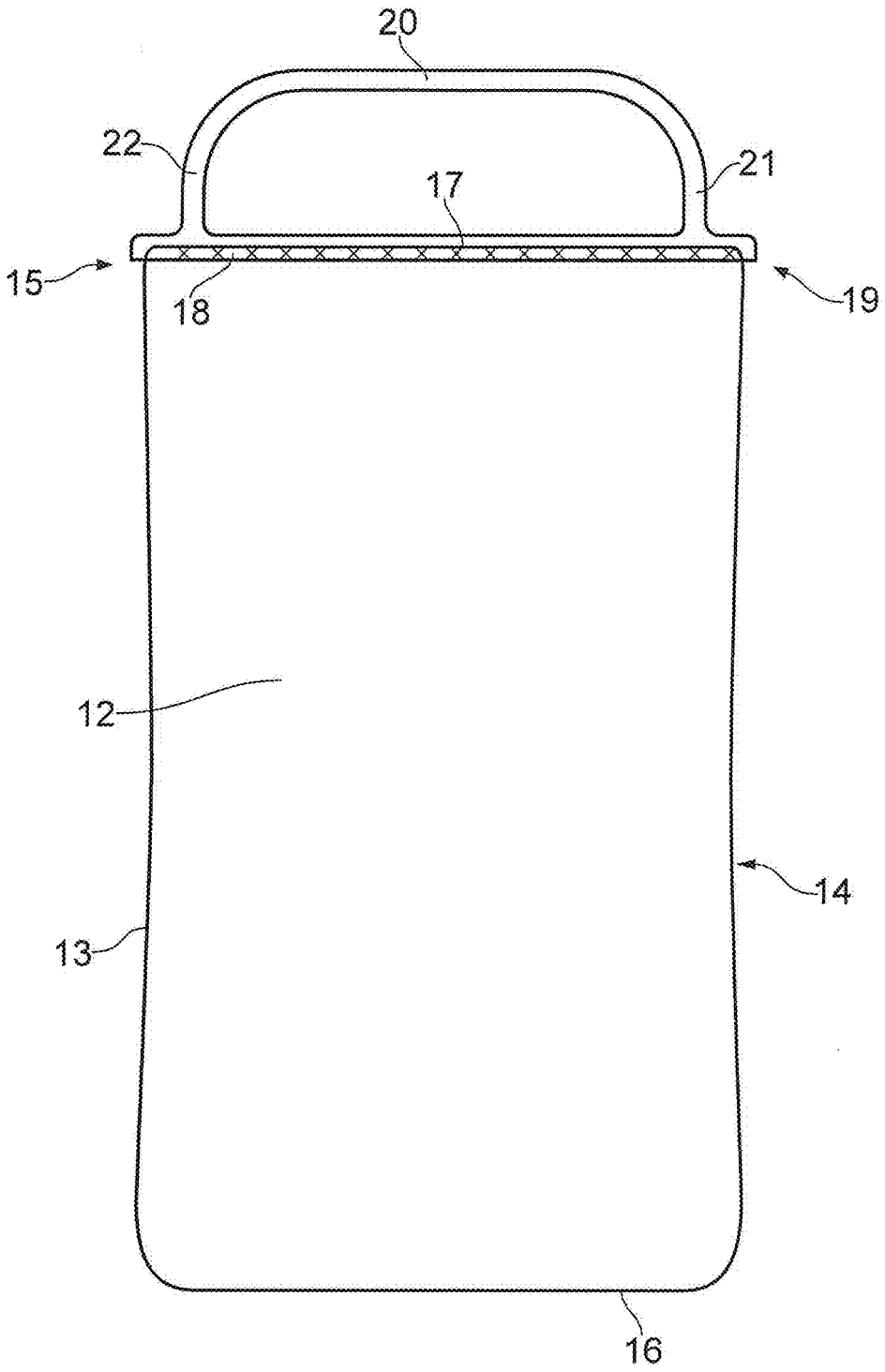
FIG. 1 is a face view of a device for use in aiding the introduction of a foot into a boot, formed as a first embodiment of the invention.
Figure 2:
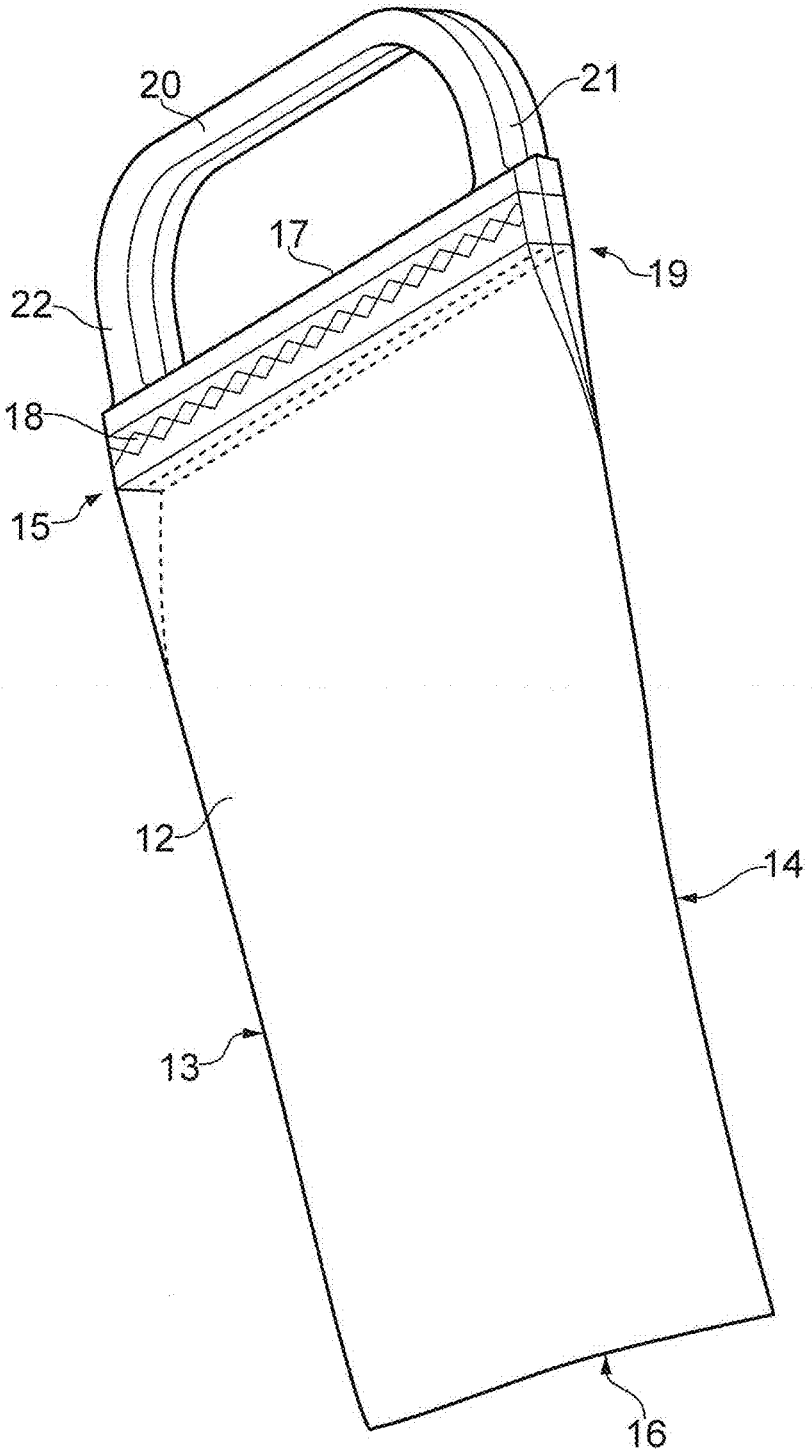
FIG. 2 is a perspective view on an enlarged scale of the handle and load-spreading member of the embodiment FIG. 1 illustrating the manner in which they are formed.
Figure 3:
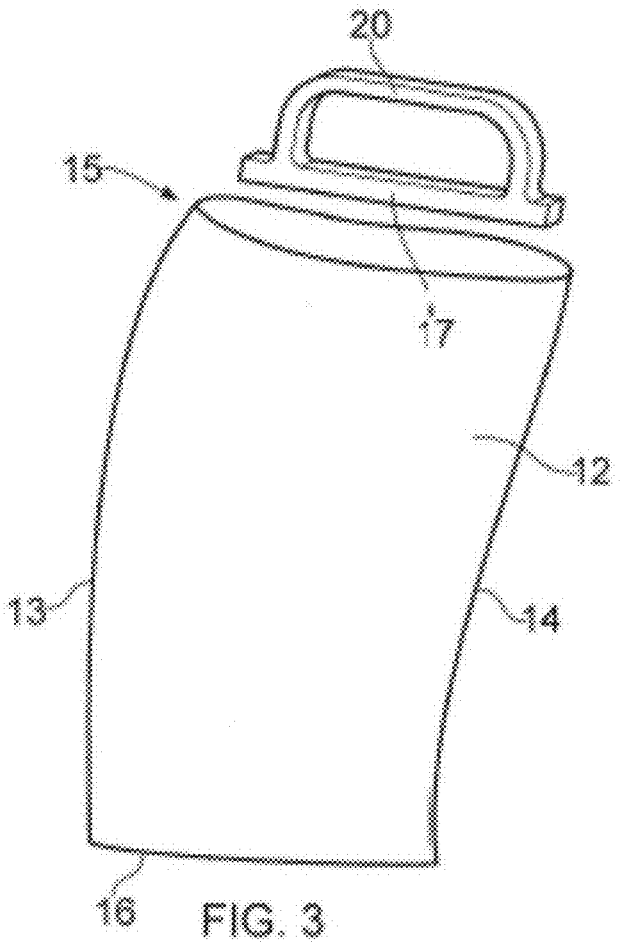
FIG. 3 is a partly exploded view of the embodiment FIGS. 1 and 2 showing a stage in the manufacturing process.

Referring first to FIG. 1, a boot-fitting aid is generally indicated 11, and comprises an elongate flexible laminar element 12 having opposite parallel long edges 13, 14 an upper or proximal end generally indicated 15, and a free or distal end generally indicated 16. The element 12 is, as can be seen in FIGS. 2 and 3, composed of two layers of material, typically polyethylene of a thickness in the range 50 to 80 micron welded together along their edges 13 and 14. In an example, a layer, or multiple layers of material can be composed of a different material or materials, which can be selected for a particular market segment or use. For example, a luxury version of a device can use a strong slippery (that is, low friction) fabric so that it is more acceptable to a particular market, such a ladies fashion boot market for example. In some instances, it may be desirable to select one material for one layer and another material for another layer. For example, a device can include one layer of polyethylene material and another layer of low friction fabric. Other alternatives will be readily apparent. In any case, it will be apparent that one or multiple layers can include printed matter thereon, and even be embossed if desired, providing that this does not impact on the use of the device—for example, embossing can be provided in a region that will not typically come into contact with a user or a garment or piece of footwear.

At the proximal end 15 the individual sheets forming the element 12 are each bonded by welding to a load-spreading member 17. In the embodiment of FIGS. 1 and 2, the entirety of the proximal end 15 of the laminar element 12 is welded to the load-spreading member 17, with each of the two individual sheets of which the laminar element 12 is composed, being separately welded to opposite faces 18, 19 of the load-spreading member 17.

In this embodiment the load-spreading member 17 is integrally formed with a generally C-shape or loop handle 20 having limbs 21, 22 joined to the ends of the load-spreading member 17. In the embodiment of FIG. 3, instead of being formed from two separate sheets the laminar element 12 is a single tubular member flattened to form two layers and the load-spreading member 17 is introduced into the open end of the tube prior to welding. The other features of the load-spreading member and handle are as shown in the embodiment of FIGS. 1 and 2. In an example, the load-spreading member can include arms at either end thereof that extend down a portion of the laminar element and which are secured thereto.

The load-spreading member is typically straight, but can be any shape and/or can be profiled. For example, depending on the requirement for design or function, the member can be curved or provided with some other shape or profile, such as to match that of a portion of a garment with which the device is to be used. The shape and/or profile of the load-spreading means can vary in three dimensions also as opposed to in just one plane. For example, the means can be curved or otherwise vary in profile or shape in one plane, and also be curved or otherwise vary in profile or shape in another (different) plane or direction. In circumstances where a garment or piece of footwear has a particular profile that varies in multiple directions, this can be advantageous so that device can be matched to a particular use for example. However, there may typically be some flex in a load-spreading means that will enable it to conform or flex in use to any particular requirement. Alternatively, it can be advantageous to maintain the load-spreading means as a substantially straight member, which can be rigid for example.

Figure 4:
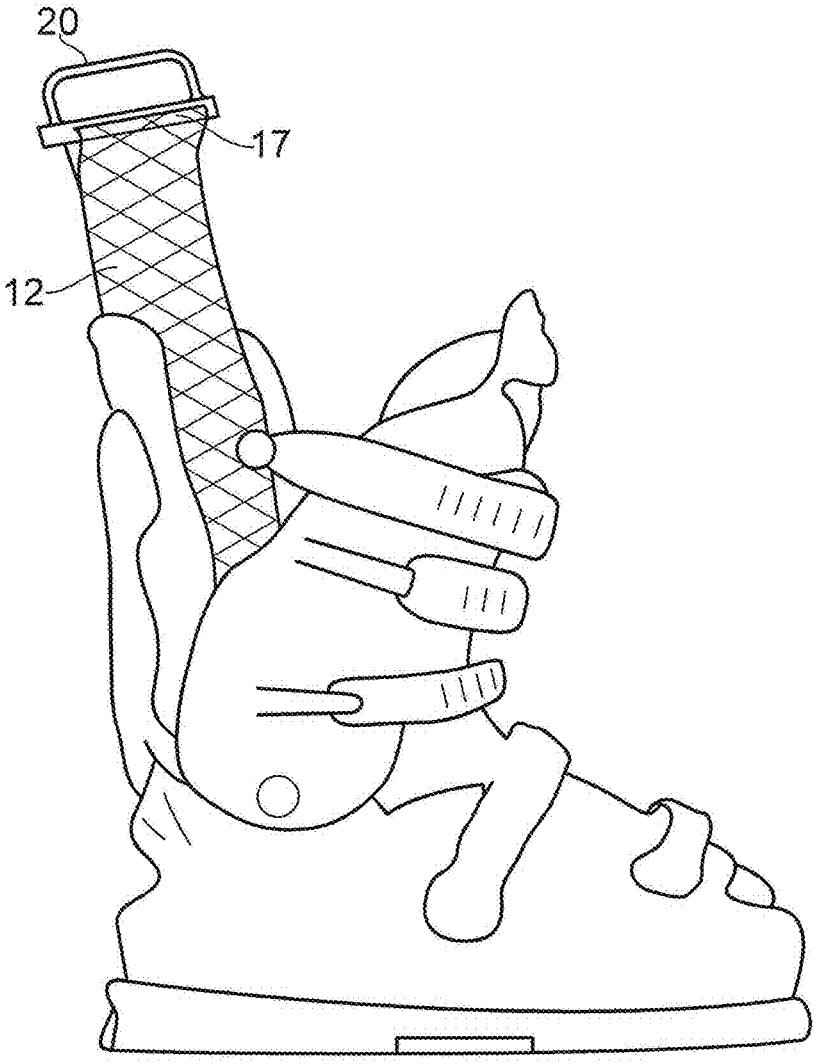
FIG. 4 is a schematic perspective view illustrating the use of the introduction aid in fitting a ski boot.

As can be seen in FIG. 4, in use of the device of the invention as a foot insertion aid the elongate flexible laminar element 12 is introduced into the heel portion of a boot or shoe, in this example a ski boot, such that it provides a low-friction surface against which a foot 23 of a user can slide in order freely to enter the boot 24. Once the foot is in the boot a force applied to the handle 20, transmitted to the elongate flexible element 12 via the load-spreading member 17, causes this to be drawn from the interspace between the foot 23 and the boot 24. The forces exerted on the elongate flexible laminar element 12 are spread by the load-spreading member 17 in such a way that each part of the element 12 receives the same tension so that there is no tendency for rupture or tearing to take place even when considerable loads are applied via the handle 20, such as may be the case when removing the device from a particularly tight fitting garment or piece of footwear for example.

Figure 5:
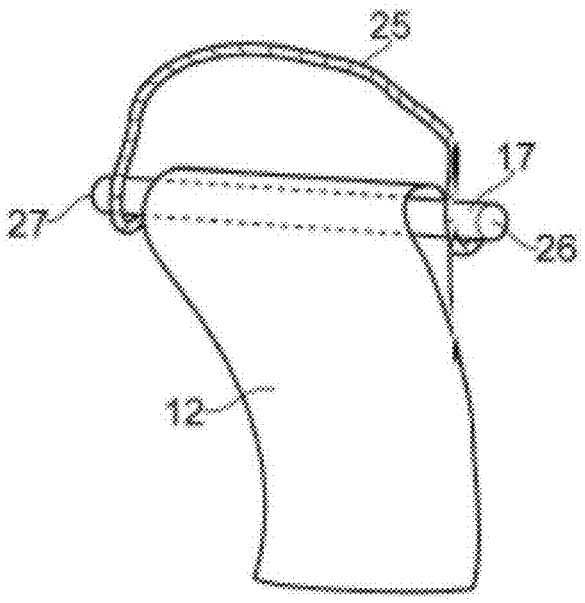
FIG. 5 is a perspective view of an alternative embodiment of the invention.

An alternative embodiment is illustrated in FIG. 5 in which the twin-layer elongate flexible element 12 is formed from a member which is twice the length, and is folded over a load-spreading member 17 which, in this embodiment, is in the form of a rod of circular cross-section. The rod 17 is longer than the width of the elongate flexible laminar element 12 so that a loop 25 of string or twine can be attached to opposite ends 26, 27 of the load-spreading rod 17. In use the insertion aid of FIG. 5 functions in substantially the same way as that of the embodiment of FIGS. 1 to 4, but after use the elongate flexible laminar element 12 can be rolled up over the circular-section load-spreading member 17 to make it a convenient shape and size for storage and to avoid any crumpling or creasing of the laminar element which might detract from the functionality of the device in future use.

Figure 6:
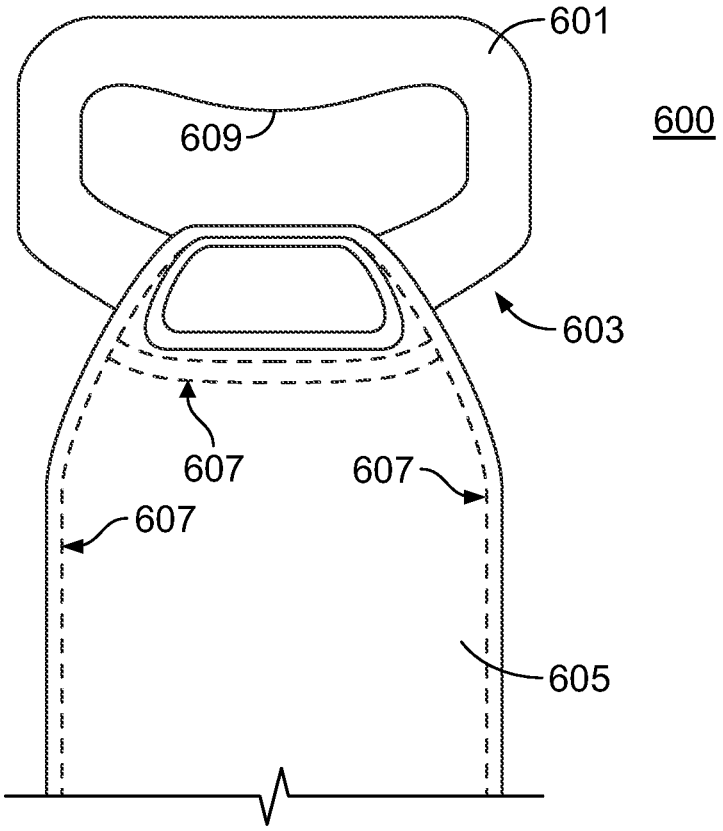
FIG. 6 is a schematic representation of a device according to an example.
Figure 7:
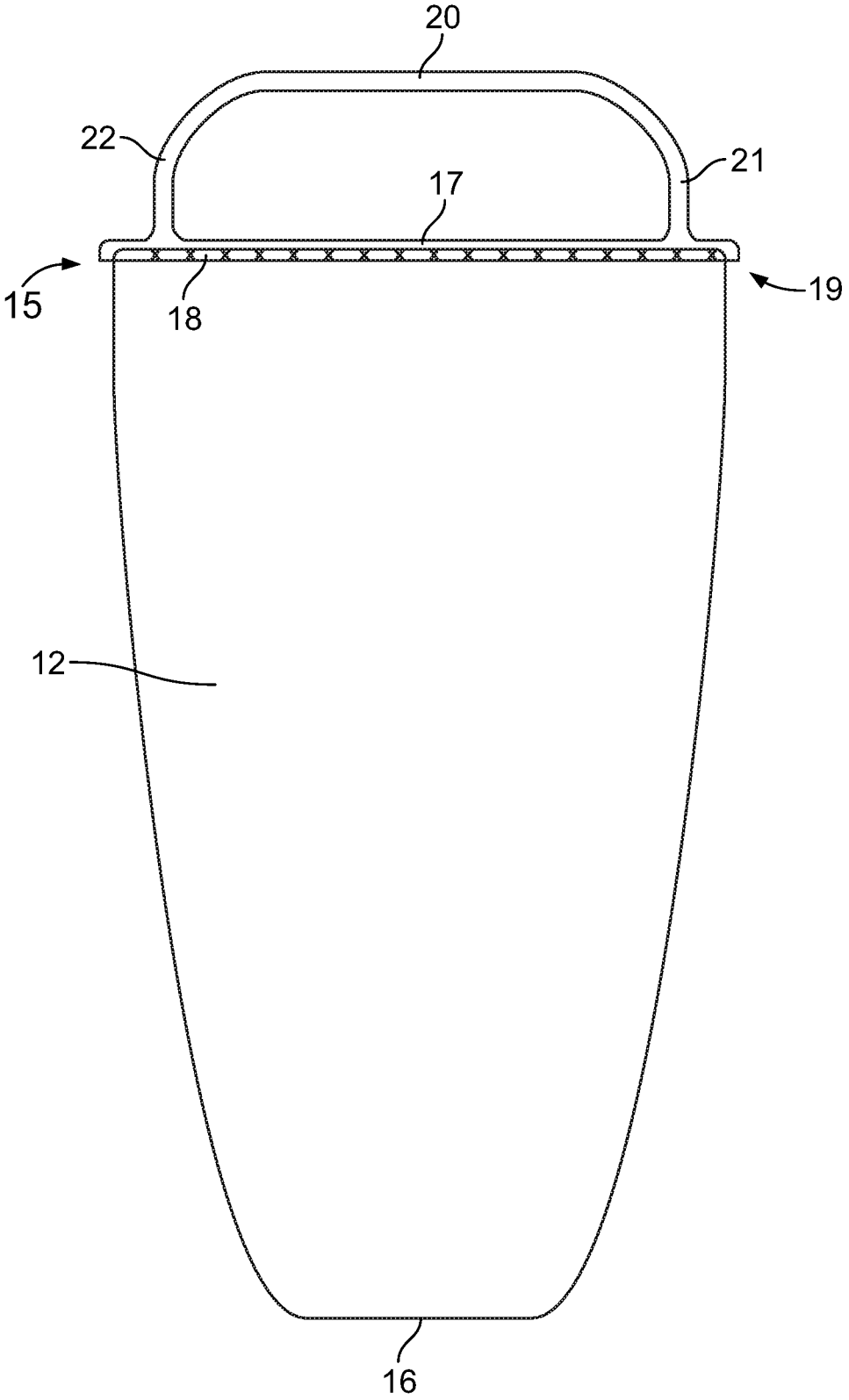
FIG. 7 is a schematic representation of a device according to an example.
Figure 8:
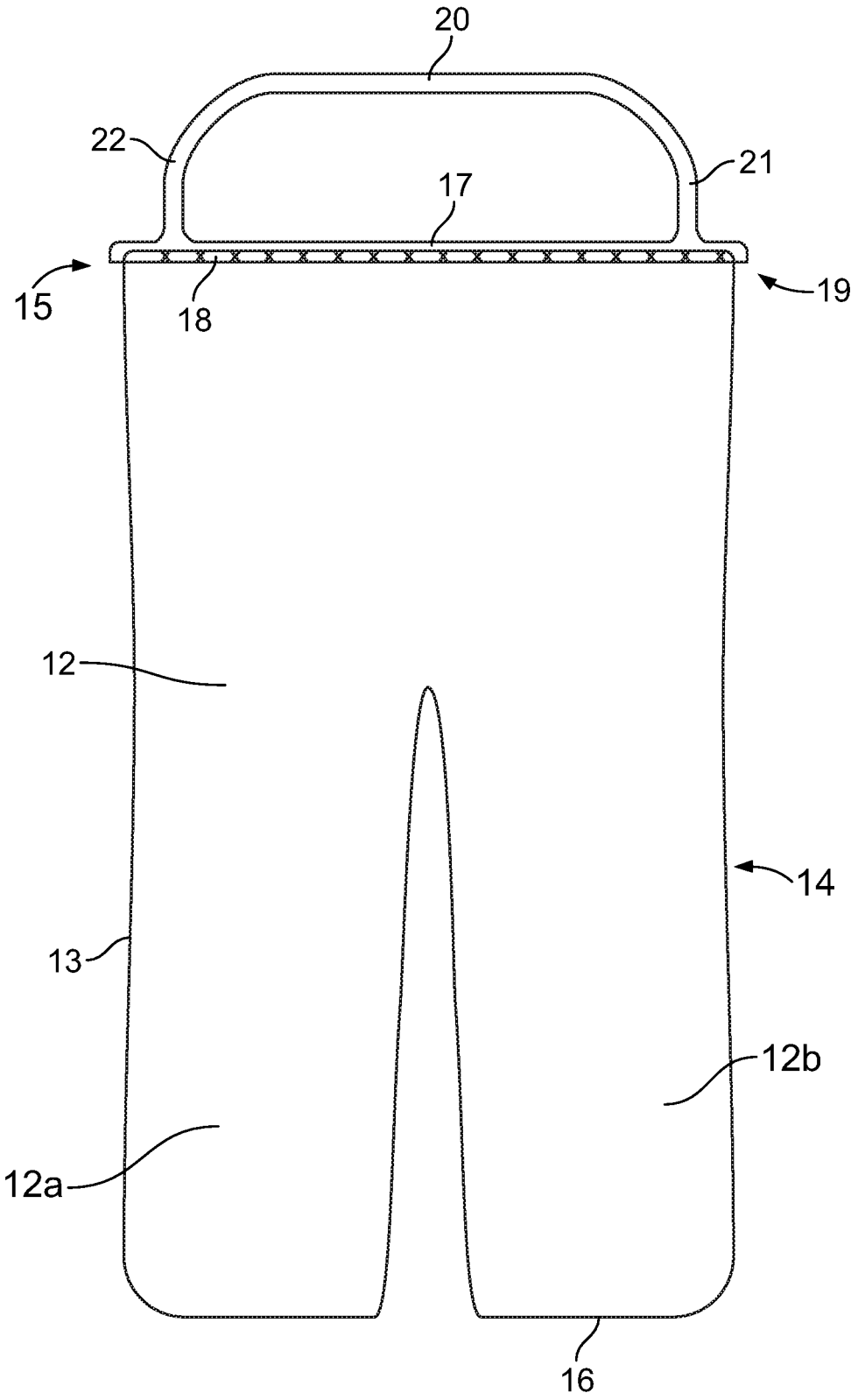
FIG. 8 is a schematic representation of a device according to an example.

FIG. 6 is a schematic representation of a device according to an example. A handle means 601 for manually gripping the load spreading means 603 of the device 600 to assist in effecting withdrawal of the laminar element 605 from the interspace between a body part and a garment or footwear into which it has been introduced is provided. In the example of FIG. 6, the element 605 is composed of a fabric, such as a rip-stop fabric as noted above, which may be coated with a low-friction material such as silicone for example. Stitching 607 is schematically illustrated. That is, the fabric of the element 605 is folded over the means 603 to provide the twin-layer elongate element 603. The two layers are stitched or sewn together down the sides and beneath the element 603, broadly as depicted. A double layer of stitching may be provided. For example, a double layer of stitching is depicted beneath means 603.

In an example, the element 605 may be a single layer of fabric. That is, the fabric can be wrapped over the means 603 and stitched beneath to hold it in place, but the length of the material is selected so that there is a single layer of fabric beneath the stitched portion. That is, the element 605 is composed of a single layer of material. A double layer is provided only at the region close to the means 603 to enable the fabric to wrap over the means and be attached to itself.

As depicted in FIG. 6, the profile of the means 603 can be selected so that the element tapers outwardly away from the handle 601, and the handle 601 and means 603 can be profiled or shaped for aesthetic reasons. A small bulge 609 can be provided on the handle 601 to assist a user in gripping the handle. The handle 601 may have surface decoration and/or surface profiling. The profiling can be to enable a better grip of the handle in use. For example, the surface of the handle may be provided with raised and/or lowered portions, dimpling and/or a rubberised portion for example.

It will be appreciated that, although a boot fitting aid has been described with reference to the figures, the same considerations apply equally to other items of footwear or to garments as well, and the above is not intended to be limiting.

The invention claimed is:

1. A device for assisting the introduction of a body part into a tightly-fitting garment or footwear, comprising an elongate flexible laminar element of low friction material having load spreading means at one end of the element, operable, when a force is applied thereto, to spread the force across substantially the entire width of the laminar element, and handle means for manually gripping the load spreading means to assist in effecting withdrawal of the said laminar element from the interspace between a body part and a garment or footwear into which it has been introduced, wherein the elongate flexible laminar element comprises individual layers, and wherein the individual layers are secured on opposite sides of the load spreading means.

2. A device as claimed in claim 1, in which the elongate flexible laminar element is a single layer.

3. A device as claimed in claim 1, in which the elongate flexible laminar element comprises multiple layers.

4. A device as claimed in claim 3, in which the elongate flexible laminar element comprises two layers joined together along their longitudinal edges.

5. A device as claimed in claim 3, in which the elongate flexible laminar element comprises two layers formed as a flattened tube.

6. A device as claimed in claim 1, in which the load spreading means are secured to the elongate flexible laminar element by welding and/or stitching and/or adhesion.

7. A device as claimed in claim 6, in which the attachment of the load spreading means to the elongate flexible laminar element is reinforced by mechanical fixing elements (such as rivets).

8. A device as claimed in claim 1, in which the said handle means are attached to the load spreading means.

9. A device as claimed in claim 1 in which the said handle means are formed integrally with the load spreading means.

10. A device as claimed in claim 1, in which the load spreading means are formed in two parts and the elongate flexible laminar element is secured to the load spreading means between the said two parts.

11. A device as claimed in claim 1, in which the elongate flexible laminar element is made of polyethylene or a rip-stop fabric.

12. A device as claimed in claim 1, in which the elongate flexible laminar element is provided with a silicone coating or layer to reduce its frictional properties.

13. A device as claimed in claim 1, in which the elongate flexible laminar element is tapered, narrowing away from or towards the said load spreading means.

14. A device as claimed in claim 1, in which the elongate flexible member includes multiple portions for insertion into a garment or footwear.

15. A device as claimed in claim 14, in which the shapes of the multiple portions substantially mirror or otherwise match a shape of a portion of a garment or item of footwear.

16. A device for assisting the introduction of a body part into a tightly-fitting garment or footwear, comprising an elongate flexible laminar element of low friction material having load spreading means at one end of the element, operable, when a force is applied thereto, to spread the force across substantially the entire width of the laminar element, and handle means for manually gripping the load spreading means to assist in effecting withdrawal of the said laminar element from the interspace between a body part and a garment or footwear into which it has been introduced, in which the elongate flexible laminar element comprises at least two layers formed as a flattened tube, and in which individual layers of the tube are secured on opposite sides of the load spreading means.

17. A device as claimed in claim 1, in which a further handle is provided on the load spreading means.

18. A device as claimed in claim 1, in which the shape and/or profile of the load spreading means matches a shape and/or profile of a portion of a garment or item of footwear.

19. A device as claimed in claim 1, in which the shape and/or profile of the load spreading means varies in multiple dimensions.

* * * * *